US006188030B1

(12) United States Patent
Livers, Jr. et al.

(10) Patent No.: US 6,188,030 B1
(45) Date of Patent: Feb. 13, 2001

(54) ADJUSTMENT APPARATUS FOR A CAM

(75) Inventors: James D. Livers, Jr., Cookeville; Robert Towe, Fairview, both of TN (US)

(73) Assignee: France/Scott Fetzer Company, Fairview, TN (US)

( * ) Notice: Under 35 U.S.C. 154(b), the term of this patent shall be extended for 0 days.

(21) Appl. No.: 09/165,817

(22) Filed: Oct. 2, 1998

(51) Int. Cl.[7] ..... H01H 43/00

(52) U.S. Cl. ..... 200/38 R; 200/19.05; 200/19.19; 200/38 BA; 74/3.52; 74/530

(58) Field of Search ..... 74/3.5, 3.52, 3.54, 74/10.27, 10.29, 10.31, 530; 200/19.02–19.08, 19.13–19.21, 33 R, 36, 37 R, 37 A, 38 R–33 B

(56) References Cited

U.S. PATENT DOCUMENTS

| | | | | |
|---|---|---|---|---|
| 3,004,449 | | 10/1961 | Feroleto | 74/567 |
| 3,214,985 | | 11/1965 | Danek et al. | 74/54 |
| 3,293,769 | | 12/1966 | Graham | 34/45 |
| 3,394,558 | | 7/1968 | Fisher | 62/233 |
| 3,396,552 | | 8/1968 | Buchser | 62/233 |
| 3,678,225 | * | 7/1972 | Hulterstrum | 200/38 BA |
| 3,723,676 | * | 3/1973 | Harris | 200/39 R |
| 3,839,925 | | 10/1974 | Ficken et al. | 74/568 R |
| 3,846,597 | | 11/1974 | Ziegler, Jr. | 200/38 BA |
| 3,958,463 | | 5/1976 | Block et al. | 74/568 R |
| 4,031,339 | * | 6/1977 | Koch | 200/38 BA |
| 4,100,381 | | 7/1978 | Marquis | 200/38 A |
| 4,203,014 | * | 5/1980 | Harris | 200/38 R |
| 4,283,607 | | 8/1981 | Brightman | 200/38 R |
| 4,344,312 | | 8/1982 | Flamme et al. | 72/452 |
| 4,348,917 | | 9/1982 | Gardner et al. | 74/568 R |
| 4,522,085 | | 6/1985 | Kane | 74/568 R |
| 4,885,437 | | 12/1989 | Tenniswood et al. | 200/31 R |
| 4,889,964 | | 12/1989 | Pea et al. | 200/31 R |
| 4,895,045 | | 1/1990 | Stidworthy | 74/568 R |
| 5,044,481 | | 9/1991 | Yoshida et al. | 192/67 R |
| 5,109,727 | | 5/1992 | Joyce | 74/568 R |
| 5,136,887 | | 8/1992 | Elrod et al. | 74/569 |
| 5,253,546 | | 10/1993 | Elrod et al. | 74/567 |
| 5,307,768 | | 5/1994 | Beier et al. | 123/90.17 |

* cited by examiner

*Primary Examiner*—Michael Friedhofer
(74) *Attorney, Agent, or Firm*—Woods,Herron&Evans,L.L.P.

(57) ABSTRACT

An apparatus for rotationally adjusting a cam, that includes an adjustment pinion having a number of missing teeth that couple to an integral gear formed on a rotatable cam. The adjustment pinion is used to manually adjust the angular position of the rotatable cam relative to the rotatable cam's axis of rotation. When the missing teeth of the adjustment pinion disengage from the gear integral to the cam, rotation of the adjustment pinion ceases. The adjustment apparatus may be readily incorporated into a programmer/timer.

10 Claims, 2 Drawing Sheets

ADJUSTMENT APPARATUS FOR A CAM

FIELD OF THE INVENTION

This invention relates to programmer/timers based upon cams and specifically to the rotational adjustment of cam profiles.

BACKGROUND OF THE INVENTION

Programmer/timers are routinely employed in appliances such as dishwashers, clothes dryers, microwave ovens and refrigerator ice makers. The programmer/timer triggers and times sequential events in an operational cycle according to a predetermined program.

Cam-operated programmer/timers typically incorporate a camstack. One familiar type of cam consists of a quasi-cylindrical drum having at least one cam profile. Each cam profile carries control information for one function of the associated appliance. To encode a cam profile, the radius of the quasi-cylindrical drum is varied around its circumference. A cam follower, in contact with the cam profile, is constrained to mechanically respond to the surface contour.

A camstack incorporates multiple cam profiles into a single drum. As the camstack rotates, each cam profile actuates one or more cam followers. Each cam follower can invoke a timed or programmed function by closing or opening an electrical contact. Devices are switched to activate integral functions performed by an appliance.

Certain appliance functions may require adjustment of event duration or event triggering in the appliance operational sequence. Since the programmer/timer is usually not easily disassembled, a remote adjustment method is required. Adjustment of an event may be required during initial setup, as the programmer/timer mechanism wears, or to account for consumer demands. Without an adjustment means, either the entire programmer/timer, as a unit, or the camstack, if accessible, would have to be replaced.

To surmount this limitation, some programmer/timers have historically incorporated an adjustment mechanism. A specific cam profile is mechanically linked to a manipulator external to the camstack enclosure. To permit adjustment, the cam profile is loosened from, or can be rotated by applying sufficient force about, the camstack's axis of rotation. Since the axis of rotation for the camstack remains static, adjacent cam profiles remain fixed. As a result, the functions controlled by the stationary cams are unaltered.

A disadvantage of this adjustment mechanism is that mechanical linkage to the cam profile cannot be disengaged. As the camstack rotates, the mechanical linkage and external manipulator are also compelled to move. Therefore, an additional mechanical load is placed on the power source that rotates the camstack.

For the foregoing reasons, an apparatus is needed that permits rotational adjustment of a cam profile in a camstack, but that can be disengaged from the camstack's drive system during periods when a rotational adjustment is not being made.

Thus, it is an object of the invention to provide an adjustment mechanism for a cam that is capable of altering the cam profile and that can be disengaged when not in use.

Further, it is an object of the invention to provide an adjustment mechanism for a camstack that is capable of altering a cam profile and that can be disengaged when not in use.

Further, it is an object of the invention to define a programmer/timer that incorporates the adjustable cam, that is mechanically simple, low cost and reliable.

SUMMARY OF THE INVENTION

In a first aspect, the invention features an adjustment pinion that alters the position of a rotatable cam, which can be decoupled from the power source driving the adjustable cam. Specifically, the adjustment pinion has missing teeth, and disengages when its missing teeth fail to enmesh with the gear teeth disposed on an annular surface of the adjustable cam.

In the specific embodiment described below, a cam follower contacts the cam surface. The cam follower translates control information encoded into a cam profile on the cam surface to actuate a device.

In this embodiment, the invention includes at least one cam that shares a common axis of rotation with an adjustable cam, is axially adjacent to the adjustable cam, and that is not rotationally adjustable. The missing tooth pinion can adjust the adjustable cam relative to the axis of rotation without altering the other cams.

In addition, the invention includes a cam-operated programmer/timer that incorporates a missing tooth adjustment pinion and an adjustable cam.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
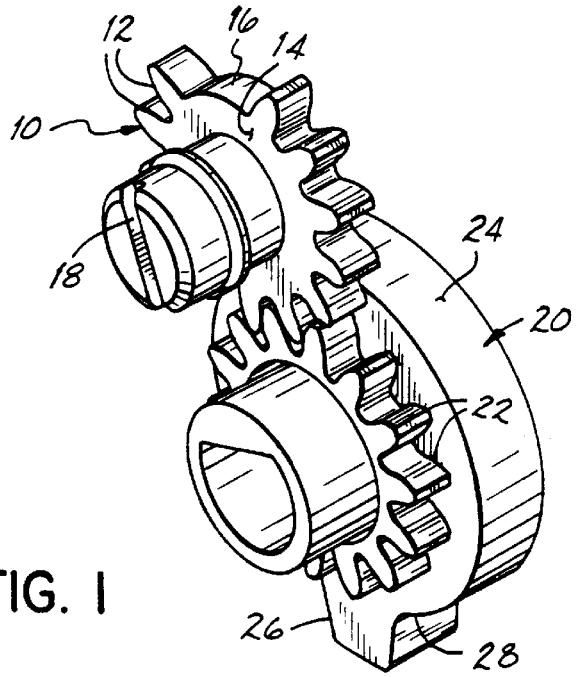
FIG. 1 is an assembled perspective view of an adjustment pinion and a rotatable cam in accordance with principles of the present invention.

Referring to FIG. 1, a rotationally adjustable cam structure in accordance with the principles of the present invention includes an adjustment pinion 10 and a rotatable cam 20. The adjustment pinion 10 includes an integral toothed gear 12 formed thereon. The rotatable cam 20 includes a cam surface 24 and an integral toothed gear 22 formed thereon. It will be understood that the adjustment pinion 10 and the adjustable cam 20 are each journalled, for free rotation thereon, on a support structure (not shown), such as, for example, a hub, a spindle, an axle, or a stanchion.

Rotatable cam 20 has an annular cam surface 24, shaped like a quasi-cylindrical drum, that incorporates a cam profile 28. A cam follower (not shown) contacts the cam surface 24. The cam profile 28 has control information for actuating a cam follower encoded by variations in the radius of the cam surface 24. A portion 26 of the circumference of the cam surface 24 has an enhanced diameter.

Adjustment pinion 10 has teeth 14 of a first tooth width, or diametral pitch, that extend around a circumference of the structure. The radius of the circumference is deemed the pitch circle. The tooth width of the adjustment pinion is selected to mate with the gear 22 formed on the adjustable cam 20. Along a selected arc length of its circumference, the adjustment pinion 10 has a second diametral pitch 16 that is smaller than the first diametral pitch 14. An adjustment means 18, such as a slot for a standard screw drive, permits manual rotation of the adjustment pinion 10. The adjustment pinion 10 is positioned such that its teeth 14 are enmeshed intermittently with the teeth of the gear 22 formed on the adjustable cam.

Figure 2A:
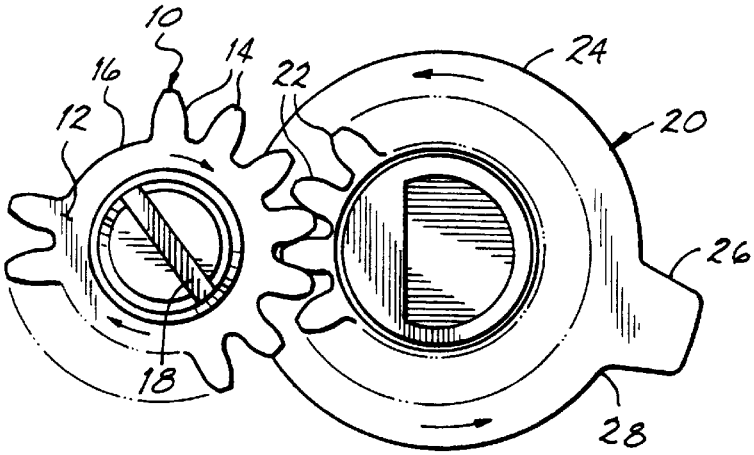
FIGS. 2A and 2B are front elevational views of an adjustment pinion and an adjustable cam.
Figure 2B:
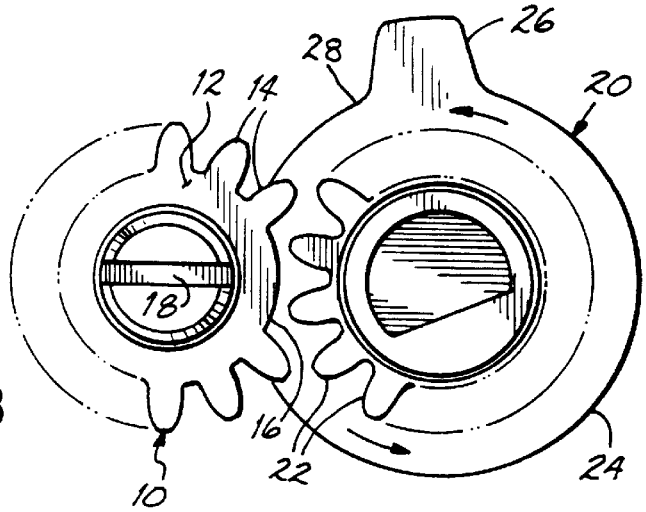

Referring to FIGS. 2A and 2B, the adjustment pinion 10 and the adjustable cam 20 are shown in two states of engagement. It will be understood that the diametral pitches of the teeth 14 and teeth 22 enable the teeth of the gears to enmesh for rotation.

Referring to FIG. 2B, the uncoupled state of the adjustment pinion 10 and the rotatable cam 20 is shown. In this uncoupled state, the adjustable pinion 10 is mechanically decoupled from the rotatable cam 20. This uncoupled state occurs when an adjustment of the cam is not being made. In this uncoupled state, gear teeth with the second diametral pitch 16 cannot engage the gear teeth 22 formed on the rotatable cam 20.

Referring to FIG. 2A, manual rotation of the adjustment pinion 10 using the adjustment means 18 causes the teeth to rotate about a first axis of rotation (not shown). As the teeth with the first diametral pitch 14 engage the teeth of the rotatable cam 22, the rotatable cam 20 rotates about its axis of rotation, while the axis of rotation remains static. To accomplish this, the rotatable cam 20 is either decoupled from its axis of rotation or the applied force to the adjustment means 18 suffices to overcome the static friction between the inner surface of the rotatable cam and the outer surface of the axis of rotation over the contact area. For example, clockwise rotation of the adjustment pinion 10 rotates the rotatable cam 20 counterclockwise. When the mechanical force is removed from the adjustment means 18, the adjustment pinion 10 rotates freely and the rotatable cam 20 resumes its coupling to its axis of rotation and the power source (not shown) driving the axis of rotation. As the rotatable cam rotates 20, the enmeshed teeth constrain the adjustment pinion 10 to also rotate. Eventually, the teeth with the smaller diametral pitch 16 rotate into opposition with the teeth 22 of the rotatable cam and motion of the adjustment pinion 10 ceases.

Figure 3:
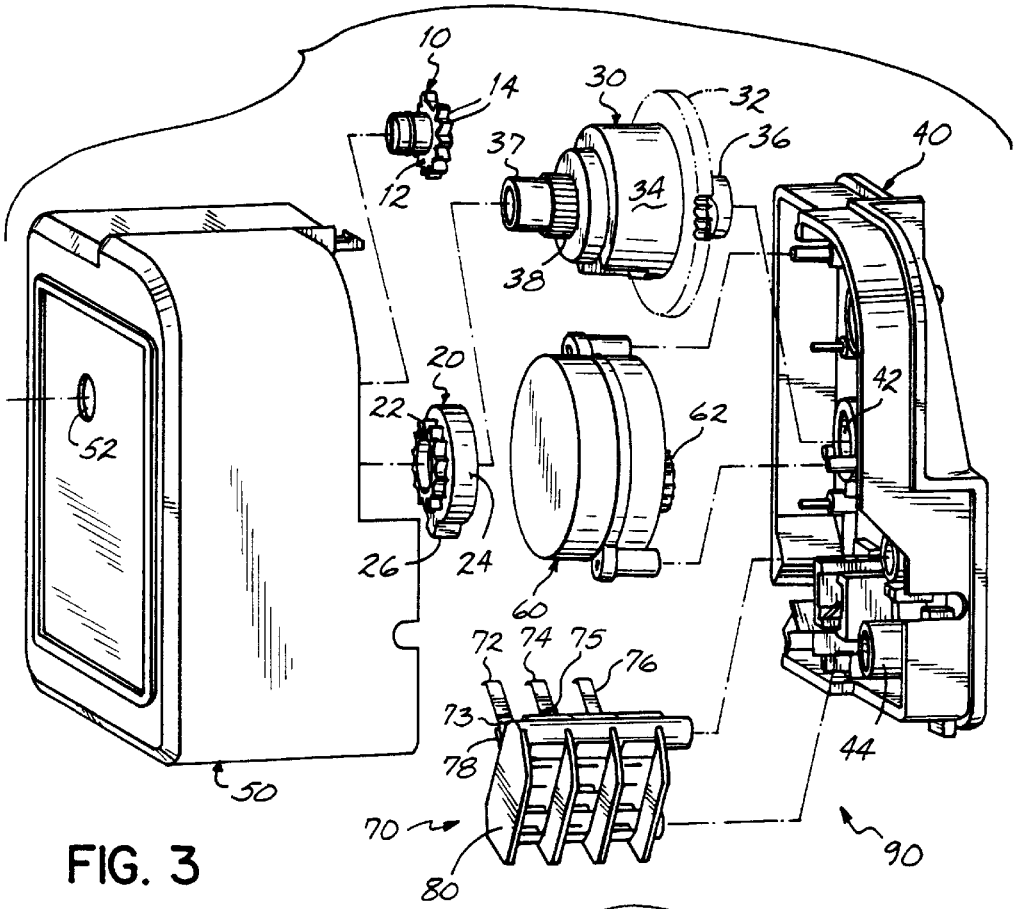
FIG. 3 is an exploded perspective view of a cam-operated programmer-timer that incorporates the present invention.
Figure 4:
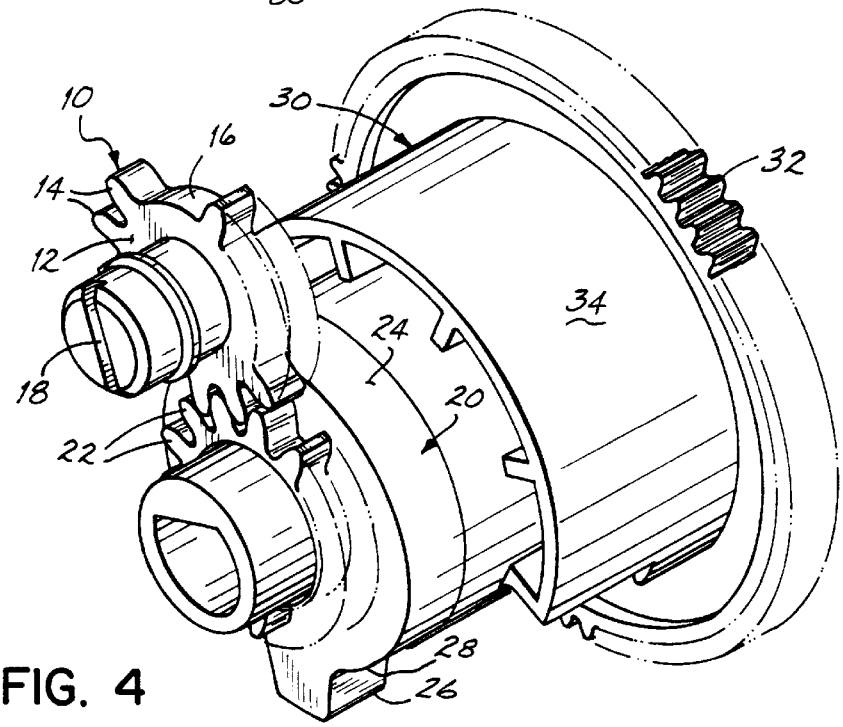
FIG. 4 is an assembled perspective view of an adjustment pinion, a rotatable cam, and a camstack.

Referring to FIGS. 3 and 4, one embodiment of the present invention is shown, wherein the adjustment pinion 10 is incorporated into a programmer/timer 90.

Referring to FIG. 3, a programmer/timer incorporating the present invention, indicated generally at 90, includes an adjustment pinion 10, a rotatable cam 20, a camstack 30, a first half-housing 40, a second half-housing 50, an electrical drive motor 60, and a cam follower assembly 70.

The camstack 30 includes an integral toothed gear 32 formed thereon, a hub or base 37, and at least one cam 34. Toothed gear 32 mechanically links the camstack 30 to a drive means for rotation. A rotatable cam 20 is joumalled onto a hub 37 mounted on the camshaft. A section of the hub 38 is knurled to secure the rotatable cam 20 so that it rotates concurrently with the camstack 30, unless sufficient force is applied through the adjustment pinion 10. The camstack 30, shaped like a quasi-cylindrical drum, has at least one annular cam 34 that incorporates a cam profile. Each cam profile has control information for actuating a cam follower 74,76.

The cam follower assembly 70 includes cam followers 74,76 and a support mount 80 for attachment to a support structure 44 on the half-housing 40. Each cam follower 74,76 is a flexible blade that contacts a cam 34. As the camstack rotates, each cam follower deflects in synchronization with its corresponding cam profile. Each cam follower has an electrical contact 75 formed integrally thereon. The deflection of the cam follower modulates the electrical connection between the electrical contact 75 and a corresponding second electrical contact (not shown) that is stationary and mounted to the support mount 80.

The electrical drive motor 60 includes an integral toothed gear 62 formed thereon. The toothed gear 62 is positioned to engage the toothed gear of the camstack 32 and drive the camstack's rotation.

A rotatable cam 20 is joumalled onto the hub 37 of the camstack 30 for rotational attachment. The knurled region 38 secures the rotatable cam to the hub 37. A cam follower 74, as described above, contacts the annular cam 34 and has an electrical contact 73 disposed at a distal end. As the camstack rotates, the electrical contact formed by the electrical contact 73 and a second stationary contact 78 is modulated.

As discussed in detail above, an adjustment pinion 10 is mechanically engaged with the rotatable cam 20 to provide for rotational adjustment.

The first half-housing 40 has spindles or stanchions 45,46 onto which the electrical drive motor 60 is rigidly mounted. An aperture 42 is provided in the first half-housing 40 to constrain the lateral movement of the camstack 30 and to permit linkage path for direct mechanical output from the drive motor 60.

The second half-housing 50 is essentially a cover that attaches to the first half-housing 40 to enclose the programmer/timer 90. The second half-housing has an aperture 52 to permit access to the adjustment means 18 of adjustment pinion 10.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A rotationally adjustable cam structure comprising:

(a) a support structure;

(b) an adjustment pinion affixed to said support structure for rotation, said adjustment pinion comprising a plurality of first teeth disposed on a pitch circle thereof, said first teeth being spaced with a given diametral pitch throughout a portion of the pitch circle of said pinion, at least two of said teeth having a smaller diametral pitch;

(c) a rotatable hub affixed to support for rotation; and (d) a first cam affixed to said rotatable hub for rotation relative to said rotatable hub, said cam comprising a cam profile disposed on a first circumference of a surface thereof and a plurality of second teeth disposed on a second circumference of a surface thereof, said second teeth positioned to be enmeshed with the teeth of the adjustment pinion;

whereby the adjustment pinion ceases to rotate when the teeth with the smaller diametral pitch of the adjustment pinion fail to engage the plurality of second teeth disposed on the cam.

2. The rotationally adjustable cam structure of claim 1, further comprising a cam follower in contact with the first cam, said cam follower actuated by the cam profile.

3. The rotationally adjustable cam structure of claim 2, further comprising a first electrical contact connected to the cam follower and a second electrical contact connect to the support, said first electrical contact switched by the cam follower.

4. The rotationally adjustable cam structure of claim 1, further comprising a second cam attached to the rotatable hub, said second cam having a cam profile.

5. The rotationally adjustable cam structure of claim 4, further comprising a cam follower in contact with and actuated by one of said first or second cam profiles.

6. The rotationally adjustable cam structure of claim 5, further comprising at least one switch contact actuated by said cam follower.

7. The rotationally adjustable cam structure of claim 1, wherein the cam further comprises a plurality of additional cam profiles disposed about a circumference of said rotatable hub.

8. The rotationally adjustable cam structure of claim 7, further comprising a cam follower in contact with and actuated by one of said cam profiles.

9. The rotationally adjustable cam structure of claim 8, further comprising at least one switch contact actuated by one of said cam followers.

10. A cam-operated programmer-timer comprising:

(a) a housing;

(b) a support structure attached to said housing;

(c) an adjustment pinion affixed to said support structure for rotation, said adjustment pinion comprising a plurality of teeth disposed on a pitch circle thereof, said teeth being spaced with a given diametral pitch throughout a portion of the pitch circle of said pinion, at least two of said teeth having a smaller diametral pitch;

(d) a rotatable hub affixed to support for rotation;

(e) a camstack affixed to said rotatable hub for rotation, said camstack comprising at least one cam disposed on a circumference thereof, the at least one cam having a cam profile;

(f) an adjustable cam disposed on a surface of said camstack, said adjustable cam able to rotate about said rotatable hub relative to said camstack and having a plurality of teeth disposed on a circumference thereof, said teeth enmeshed with the teeth of the adjustment pinion; and (g) a means attached to said cam providing rotation of the adjustable cam profile, whereby the adjustment pinion ceases to rotate when the teeth of the adjustment pinion with the smaller diametral pitch fail to engage the plurality of teeth disposed on the surface of the cam.

* * * * *